US007681329B2

(12) United States Patent
Fu

(10) Patent No.: US 7,681,329 B2
(45) Date of Patent: Mar. 23, 2010

(54) VENTILATED FOOTWEAR

(76) Inventor: Victor Fu, 78 Lake Forest Dr., Daly City, CA (US) 94015

( * ) Notice: Subject to any disclaimer, the term of this patent is extended or adjusted under 35 U.S.C. 154(b) by 470 days.

(21) Appl. No.: 11/755,580

(22) Filed: May 30, 2007

(65) Prior Publication Data

US 2008/0052967 A1 Mar. 6, 2008

Related U.S. Application Data

(60) Provisional application No. 60/820,362, filed on Jul. 26, 2006.

(51) Int. Cl.
*A43B 7/06* (2006.01)
*A43B 13/20* (2006.01)

(52) U.S. Cl. ..... 36/3 B; 36/3 R; 36/29; 36/35 B

(58) Field of Classification Search ..... 36/3 B, 36/3 R, 29, 35 B
See application file for complete search history.

(56) References Cited

U.S. PATENT DOCUMENTS 2,863,230 A * 12/1958 Cortina ..... 36/29
5,505,010 A * 4/1996 Fukuoka ..... 36/3 B
5,701,687 A * 12/1997 Schmidt et al. ..... 36/29
5,975,861 A * 11/1999 Shin et al. ..... 417/234
6,581,303 B1 * 6/2003 Tuan ..... 36/3 B
7,331,121 B2 * 2/2008 Lo ..... 36/3 R

* cited by examiner

*Primary Examiner*—Ted Kavanaugh
(74) *Attorney, Agent, or Firm*—Joseph L. Strabala

(57) ABSTRACT

In footwear having a permeable top side, an insole and heel associated with its outer sole, an improved circulation system includes a plurality of perforated air channels tanned in the insole, a compressible pump means having an inlet and an outlet located in a cavity in the footwear's heel, a reciprocal ball piston located below the pump means in the heel so the piston extends beyond the base of the heel when heel is not in contact with a walking surface and is operable to actuate the pump when the heel of the footwear engages a walking surface daring the wearer's ambulatory movement, an air passage connecting the inlet of the pump to the plurality of air channels, a second air passage connecting the outlet of the pump with the atmosphere, and one way check valves in each air passage allowing air to flow in only one direction in its associated air passage whereby the cycling of the piston will circulate air though the footwear.

5 Claims, 4 Drawing Sheets

VENTILATED FOOTWEAR

This application is a continuation-in-part of Provisional Patent Application No. 60/820,362 filed Jul. 26, 2006 by Victor H. Fu.

BACKGROUND OF THE INVENTION

The present invention relates to forced air circulation through shoes, hoots and the like (footwear), employing a pomp which exhausts air from inside the shoe from pumping action created the by ambulatory movement of the wearer actuating a pomp by drawing air into the footwear through a permeable upper which replaces the air in the footwear with fresh air, as the interior air is exhausted by the pump.

Footwear of this type is often referred to as 'ventilated' footwear, for example see U.S. Pat. No. 5,505,010 issued to Fukuoka, which teaches a bellows type pump in the heel of a shoe that is actuated by a diaphragm in the shoe's heel during the wearer's movements which depresses the diaphragm that in torn compresses the bellows pump to exhaust air from the interior of the shoe. Another type of air circulation system, employing the wearer's movement for actuation, is shown in U.S. Pat. No. 5,845,417 issued to Reed et at that operates a pump located in the insole of a shoe when the wearer's weight is applied to the insole of the shoe. A similar device is shown in U.S. Pat. No. 5,675,914 issued to Cintron. Also see U.S. Pat. No. 4,078,321 issued to Famolare, Jr. where cooling air is pumped through the port into and out of the network of canals by the expansion and contraction of a pump chamber in the insole as a wearer walks. Another similar device is shown in U.S. Pat. No. 5,515,622 issued to Lee et al that exhausts air from the interior of a shoe as a wearer ambulates. U.S. Pat. No. 6,981,339 issued to Szczesuil, et al. teaches the use of mechanical pump, with a separate power source, to circulate air through out the interior of a shoe. In these and other patents, air is drawn into the shoe through its permeable top side (upper) or forced out of such permeable top side (upper) by a pump, to achieve cooling in the interior of the slice with fresh air entering the shoe.

With the exception of powered air pumps, e.g., battery powered, there is limited space available in a shoe to incorporate a wearer actuated pump. This structure limits the capacity of the pump to create air circulation in the interior of the shoe or the like. In addition, shoes and the like with such air circulation systems need to operate in various environmental conditions such as dusty roads, wet streets and/or sandy surfaces.

Cooling the interior of slices and the like, is desirable during outdoor activities, especially in the summer months, such as walking, mountain climbing, hiking, construction, and the like where the outside temperature may rise to more than 100 degrees F., often elevating the temperature inside a person's shoe to a 140 degrees F., causing the wearer's foot to sweat profusely. Once a wearer's foot begins to sweat, a wearer may develop athlete's foot blisters and foot odors.

According to this invention, it is an object to increase the pump capacity of a bellows type pump located in the heel of modified footwear having internal air circulation for cooling.

It is also an object to obtain positive activation of the bellows type pump located in the heel of a modified shoe equipped with the instant invention due to ambulatory movement of a wearer.

It is another object of the present invention is to provide lighter weight shoes while providing internal air circulation in the shoe by utilizing a cavity for the bellows type pump and a reciprocal piston.

It is also a object to use a ball as a reciprocal piston to avoid malfunctions and to allow such a piston to be easily replaced when wear on the piston requires it to be changed.

A further object is to employ a ball as a piston which is less likely to be entangled with environment and/or trip the wearer, such as depressable, fixed protrusions extending from the heel of footwear.

Still another object of the invention is a novel cooling system for footwear that can be disabled if desired, such as during cooler weather.

SUMMARY OF THE INVENTION

According to the present invention, the foregoing objects are attained in a footwear having a permeable top side, an insole and outer sole with a heel, which includes a plurality of perforated air channels formed in the insole, a compressible pump means having an inlet and an outlet located in a cavity in the footwear's heel, a reciprocating piston located below the pump means and having a portion thereof extending beyond the plane of the heel and operable to actuate the pump when the heel of the footwear contacts a walking surface, depressing the piston during the wearer's ambulatory movement, an air passage connecting the inlet of the pump to the plurality of air channels, a second air passage connecting the outlet of the pump to a vent and valve means in each of the air passages to restrict air flow to a single direction therein.

In one embodiment the air passage is connected to inlet of the pump and in the other the air passage is connected to the outlet of the pump. In either case, air circulation is effected in the interior of the footwear by the cyclic compression of the pump by the piston, as a wearer ambulates.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated and constitute a part of the specification, illustrate embodiments of the invention and, together with the description, serve to explain the principles of the invention.

DESCRIPTION OF PREFERRED EMBODIMENTS

Embodiments of the present invention are described in detail in accordance with the accompanying drawings.

Figure 1:
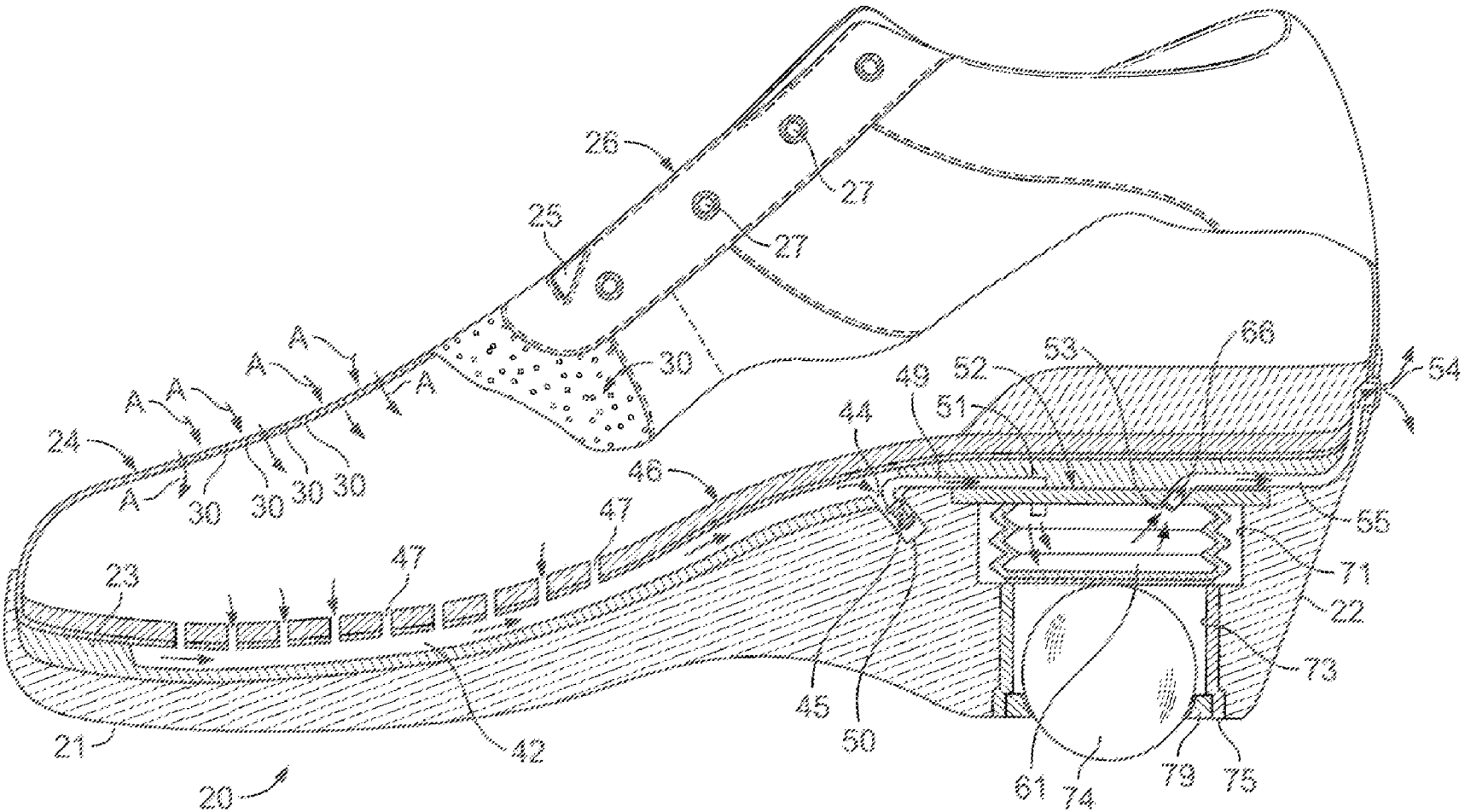
FIG. 1 is a cross section the shoe, with parts broken away, illustrating one embodiment of the present the present invention incorporated in footwear.

The present invention for footwear is illustrated in an embodiment of a shoe 20 in FIG. 1. The shoe typically has an outer sole 21 with an incorporated heel 22, a layered insole 23 and a permeable top or upper 24, fastened to the outer sole in a conventional manner. The shoe can include a tongue 25 and a typical shoe closure 26 such formed as the lace eyes 27 and laces not shown.

In this embodiment, the upper 24 is formed with at least one section, and preferably several, of permeable material, such as webbing or open weave canvas, which includes a plurality of perforations or openings 30 that allow fresh air outside the shoe 20 to pass there through into the interior of the shoe, as indicated by arrows A.

Figure 2:
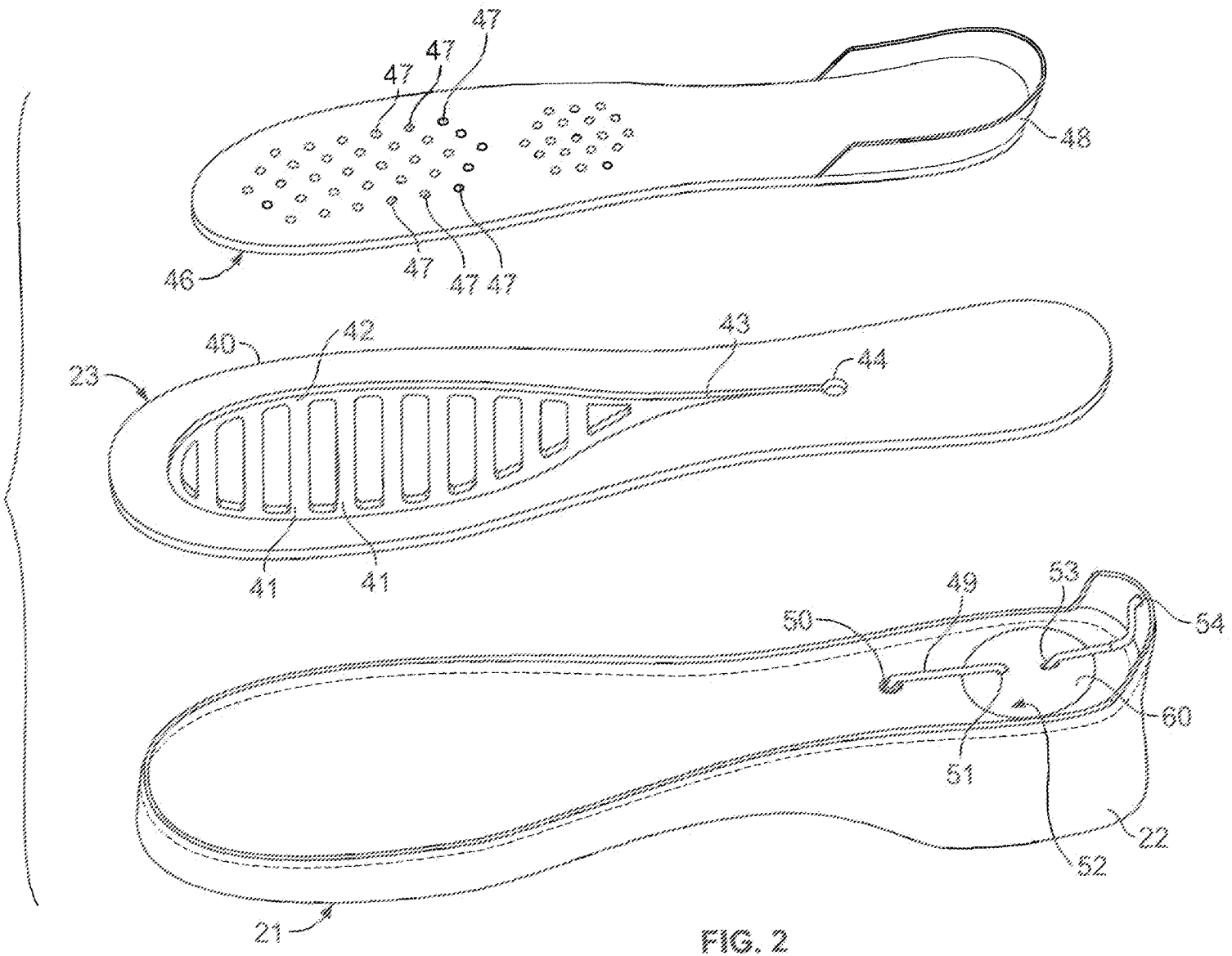
FIG. 2 is an exploded perspective of the layered insole and outer sole of the footwear constructed according to this invention.

As can be seen in FIG. 2, the insole 23 is fabricated of a layered construction, including a channeled insole 40, that mounts on the top of out sole 21 and includes a series of cross channels 41 and longitudinal channels 42 that commonly are connected with an air passage 43 that is ported though this layer via port 44. Layered on the top of the channeled insole 40 is a perforated insole 40 that includes a plurality of perforations 47 which can be attached by glue or vulcanizing to the top of the channeled insole. When so attached, it can be appreciated that air can circulate through these perforations in the perforated insole and into the cross and longitudinal channels and thence into the air passage and to its port. The perforated insole can include a curved margin 48 at the heel end that provides support for a wearer's heel when the shoe is folly formed.

The perforated insole 46, layered with the channeled insole 40 forms the insole 23 that is attached to the outer sole 21 of the shoe 20 by glue or vulcanizing. When the insole is registered with the outsole the port 44 registers with a well 50 formed in the heel area outer sole 21 that includes a one way valve 45 in the well (valve 45 not show in this figure but shown in FIG. 1) that connects to the inlet 51 of pump 52 via tubing 49. The one way valve only allows air to enter the pump from the interior of the shoe 20 when the pump creates a vacuum during a pumping cycle. The outlet 53 of the pump is vented to the atmosphere through a vent 54 connected to air tubing 55 that includes a one way valve 66 (not shown in this FIG. but see FIG. 3). This valve blocks flow in this tubing when the pump is in a vacuum cycle. As a result of this construction and one way valves, the pump will suck air from the interior of the shoe 20 during the vacuum cycle and exhaust this air through the vent during the pump cycle in conventional manner.

The one way valves are conventional, such as ball or flapper valves that close when a reverse air flow is encountered by the valve, such as created by the vacuum or pressure cycle of the pump. Without the one way valves a positive pumping cycle cannot occur.

Figure 3:
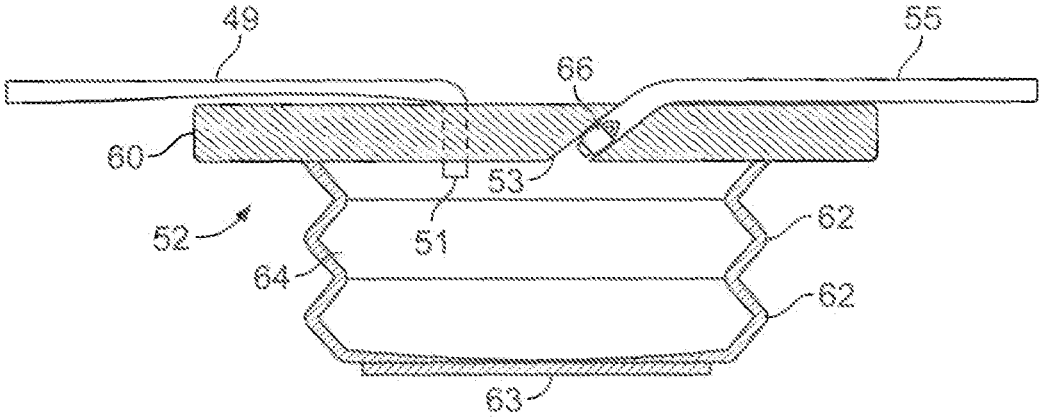
FIG. 3 is a cross section of the bellows type pump employed in the current invention.

The pump 52 is best illustrated in FIG. 3. It includes a circular base member 60 that has mounted thereon a circular bellows unit 61 constructed of elastic rubber or polyethylene, polypropylene and styrene butadiene rubber. Since the bellows unit, has a series of folds 62, is closed at one end 63 and sealable mounted on the base member at the other, it forms a closed chamber 64. This chamber is accessed by the inlet 51 and the outlet 53 of the pump and it can be appreciated if the bellows (folds) are compressed it will exhaust air contained in the chamber and if it expands, it will suck air into the chamber due to respective changes of volume of the chamber. By incorporating a one way valve in the outlet allowing air to exit though this passage (but not ingress), such as valve 66, and a similar valve in the inlet, but reversed to allow flow into the chamber (but not out of the chamber), cycling the bellows unit will result in a pumping action, sucking air into the chamber as it expands and exhausting air from the chamber as it is compressed.

The bellows unit 61 is composed of stiff materials so that it will not distort as either a vacuum or a pressure is created in chamber 64. Further it is constructed in an expanded configuration whereby it will naturally expand to that configuration due to the memory in its materials. However, in some embodiments a coil spring (not shown) can be placed in the chamber to aid in the expansion of the bellows unit and extension of the piston when it is not in contact with a walking surface. Further the closed end 63 of the bellows unit is reinforced so that it will not distort when contacted by the ball piston described, infra, and thereby lose pumping efficiency. As can be seen in FIG. 3 the base 60 of the pump is installed in the heel of the footwear and connected to air passages so it can suck air from the interior of the shoe 20 and exhaust it though vent 54. Once the base 60 is installed in a recess in the heel the insole 23 composed of the perforated insole 46 and the channeled insole 40 is laminated to the outer sole 21 covering the pump and connecting the air passages hereinbefore described. Also, the at this time upper of the shoe is laminated to the insole and outer sole, as well.

Figure 4:
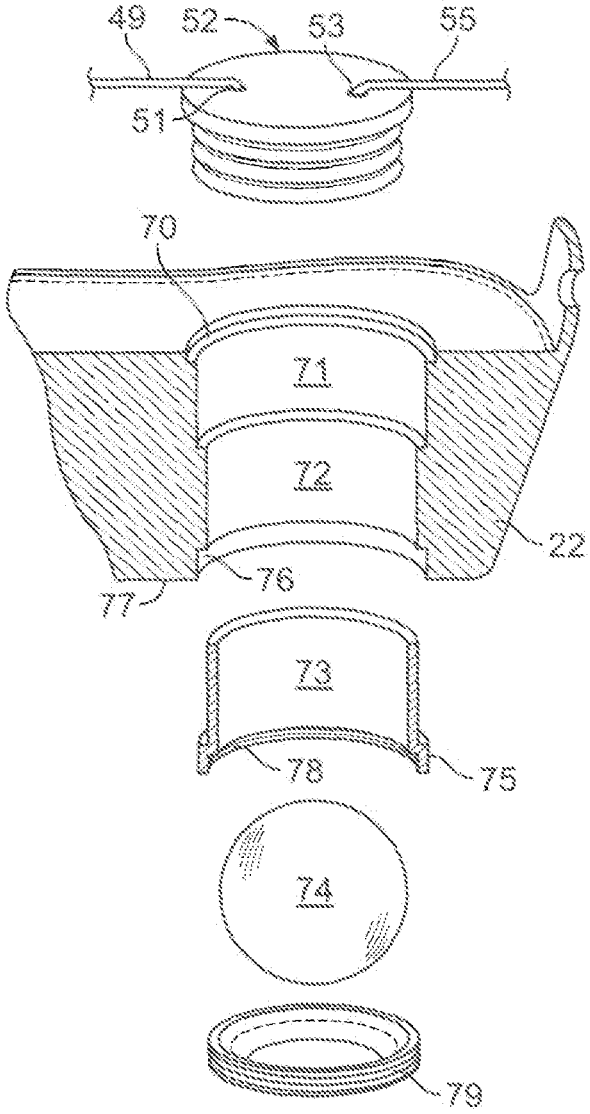
FIG. 4 is an exploded view of the components in the heel portion of the footwear constructed according this invention with the forward part and the top part of the footwear broken away.

Referring now to FIG. 4, the detail of the heel construction of the novel footwear is illustrated. Generally the heel 22 of the outer sole 21 is cored with a stepped bore, having a large diameter 70 for receiving the base 60 of the pump 52, a smaller diameter 71 for receiving the pump's bellows unit 61 and a still smaller diameter 72 for receiving the sleeve 73 for the reciprocating ball piston 74. The sleeve included a flanged base 75 that is received in recess 76 in the base 77 of the heel. Internal threads 78 are provided at the base of the sleeve and once the ball piston is inserted into the sleeve a ball retaining ring 79 can be screwed into these internal threads to retain the ball in the sleeve. Since the retaining ring does not close the entire bottom of the sleeve a portion of the ball piston will project below the flanged base when extended. Because of the forgoing construction, in colder weather, when cooling in the interior of the footwear is not desired, the ball retaining ring can be unscrewed, the ball piston 74 removed and a plug (not shown) can be screwed into the threads of the sleeve closing it thereby disabling the pump 52.

Figure 5:
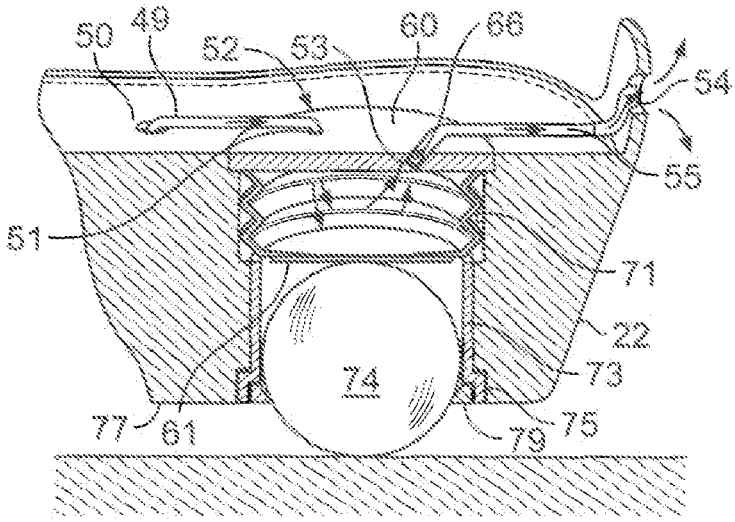
FIG. 5 is a cross section of the heel portion of the footwear according to this invention with the forward portion and top portion thereof broken away which illustrates the ball piston extended from the heel.
Figure 6:
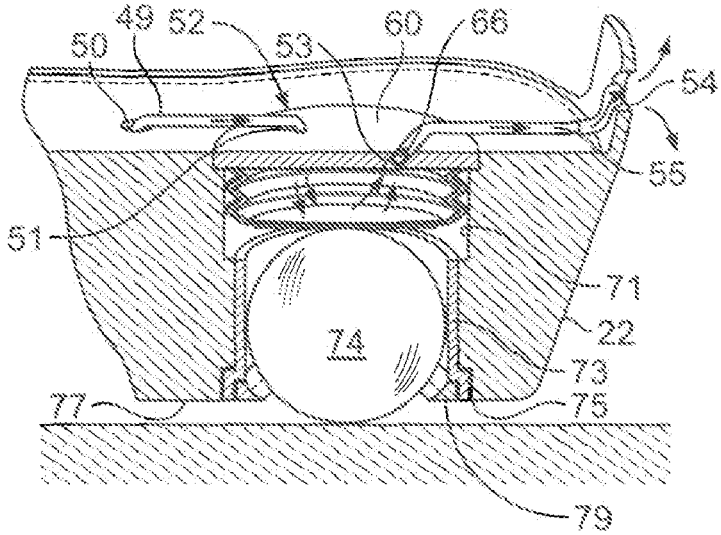
FIG. 6 is the same cross section of the heel illustrated in FIG. 5 but showing the ball piston partially depressed.
Figure 7:
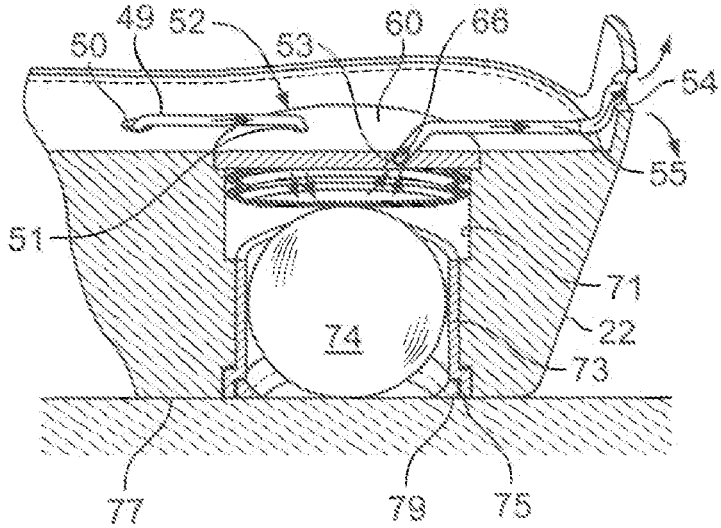
FIG. 7 is the same cross section of the heel illustrated in FIG. 5 with the ball piston folly depressed.

The extension of the part of the ball piston 74 below the base 77 of the heel 22 is best illustrated in FIG. 5 where this piston is fully extended and the bellows unit 61 is fully expanded. As additional weight is applied to the footwear the base of the heel will approach the walking surface, as shown in FIG. 6, partly depressing the bah piston which in turn compresses the bellows unit 61 which reduced the volume of chamber 64 and expelling the air therein through vent 54. In FIG. 7 the ball piston is fully depressed and in turn the chamber of the bellows unit is at its smallest volume. It can be appreciated as the heel is lifted from the walking surface, that the bellows unit will drive the ball piston down the sleeve 72 to the position of the ball piston shown in FIG. 5 when it free of contact with the walking surface, during which time air from the interior of the foot wear is drawn in to the chamber 64 completing a pumping cycle, as described.

Because the piston is a ball and can rotate in the sleeve 73 it is less likely to catch on irregularities on the walking surface as the wearer walks across it.

I claim:

1. Ambulatory activated footwear cooling system comprising:

footwear having a permeable top side, an insole and outer sole with a heel having a bottom surface;

a plurality of perforated air channels formed in the insole of said footwear connected to a common air passage;

a compressible pump means located in a cavity in said heel, said pump means having its inlet connected to such air passage in said footwear and its outlet vented to the atmosphere;

a reciprocating ball piston means located below the pump means and having a portion its ball extending beyond the bottom surface of the heel when not in contact with a walking surface, said ball operable to actuate the pump when said heel of said footwear contacts a walking surface driving said ball into said heel operating said pump means; and valve means in said air passage operable to only allow air flow from the interior of said footwear to said pump means and a second valve means in the outlet operable only allow air flow from said pump means to the atmosphere.

2. The ambulatory actuated footwear described in claim 1 wherein the ball is retained in the heel of the footwear by a threaded ring that can be unscrewed to remove said ball.

3. The ambulatory actuated footwear described in claim 2 wherein the ball is be removed by unscrewing the threaded ring to deactivate the cooling feature and replaced with a plug to keep foreign materials out the ball piston means.

4. Ambulatory activated footwear with a cooling system comprising:

footwear having a permeable top side, an insole and outer sole with an incorporated heel having a bottom surface;

a plurality of perforated air channels communicating with the interior of said footwear formed in the insole of said footwear, such channels connected to a common air passage;

a compressible bellows pump means located in a cavity in said heel, said pump means having its inlet connected to such common air passage in said footwear and its outlet vented to the atmosphere;

a piston sleeve located below said bellows pump means and fixedly received in said heel;

a reciprocating ball piston means located in said sleeve, the ball of said ball piston means having a portion thereof extending beyond the bottom surface of the heel when said heel is not in contact with a walking surface and said ball operable to actuate said pump means when said heel of said footwear contacts a walking surface driving said ball into said sleeve;

a retaining ring received at the bottom end of said sleeve operable to retain said ball in said sleeve when said heel is not in contact with a walking surface; and valve means located such common air passage operable to restrict air flow to a single direction therein whereby said pump means can only exhaust air from the interior of said footwear and second valve means in the outlet of the said pump means operable to prevent air from the exterior of said footwear form entering said ball piston means.

5. The ambulatory actuated footwear described in claim 2 wherein the ball is an elastomer ball.

* * * * *